US010072661B2

(12) United States Patent
Ozu et al.

(10) Patent No.: US 10,072,661 B2
(45) Date of Patent: Sep. 11, 2018

(54) ROTATORY COMPRESSOR AND REFRIGERATING CYCLE DEVICE

(71) Applicant: GUANGDONG MEIZHI COMPRESSOR CO., LTD., Foshan (CN)

(72) Inventors: Masao Ozu, Foshan (CN); Weimin Xiang, Foshan (CN); Jijiang Yu, Foshan (CN); Hong Guo, Foshan (CN); Jingtao Yang, Foshan (CN); Cheng Zhang, Foshan (CN); Bin Gao, Foshan (CN); Ling Wang, Foshan (CN)

(73) Assignee: GUANGDONG MEIZHI COMPRESSOR CO., LTD., Foshan (CN)

( * ) Notice: Subject to any disclaimer, the term of this patent is extended or adjusted under 35 U.S.C. 154(b) by 31 days.

(21) Appl. No.: 14/773,880

(22) PCT Filed: Oct. 31, 2013

(86) PCT No.: PCT/CN2013/086363
§ 371 (c)(1),
(2) Date: Sep. 9, 2015

(87) PCT Pub. No.: WO2015/062048
PCT Pub. Date: May 7, 2015

(65) Prior Publication Data

US 2016/0231038 A1 Aug. 11, 2016

(51) Int. Cl.
*F04C 29/12* (2006.01)
*F04C 15/00* (2006.01)
(Continued)

(52) U.S. Cl.
CPC ..... *F04C 29/12* (2013.01); *F04C 15/0092* (2013.01); *F04C 18/356* (2013.01);
(Continued)

(58) Field of Classification Search
CPC ..... F04C 18/356; F04C 2/356; F04C 29/068; F04C 29/12
See application file for complete search history.

(56) References Cited

U.S. PATENT DOCUMENTS 2,988,267 A 6/1961 Kosfeld
3,003,684 A * 10/1961 Tarleton ..... F25B 31/026 417/372
(Continued)

FOREIGN PATENT DOCUMENTS

CN 101354041 A 1/2009
CN 101526084 A 9/2009
(Continued)

OTHER PUBLICATIONS

PCT/CN2013/086363 English Translation of the International Search Report dated Aug. 13, 2014, 2 pages.
(Continued)

*Primary Examiner* — Mary A Davis
(74) *Attorney, Agent, or Firm* — Lathrop Gage L.L.P.

(57) ABSTRACT

A rotatory compressor and a refrigerating cycle device are provided. The rotatory compressor includes a lubricating oil in an interior of a hermetically sealed housing, and an electric motor and a rotatory compressing mechanism disposed in the housing. An internal pressure of the housing is substantially equal to a suction pressure of the compressing mechanism. The compressing mechanism includes a first bearing and a second bearing at least one of which includes an exhaust muffler. A refrigerant of the exhaust muffler flows through the sliding vane chamber and is discharged from an exhaust pipe of the compressing mechanism.

11 Claims, 4 Drawing Sheets

(51) Int. Cl.

| | |
|---|---|
| ***F04C 29/06*** | (2006.01) |
| ***F04C 29/02*** | (2006.01) |
| ***F04C 23/00*** | (2006.01) |
| ***F04C 18/356*** | (2006.01) |

(52) U.S. Cl.
CPC ..... *F04C 23/008* (2013.01); *F04C 29/02* (2013.01); *F04C 29/068* (2013.01); *F04C 23/001* (2013.01)

(56) References Cited

U.S. PATENT DOCUMENTS

| | | | | |
|---|---|---|---|---|
| 5,557,944 | A | 9/1996 | Hirano et al. | |
| 6,592,347 | B2 * | 7/2003 | Matsumoto | F04C 18/3564 418/178 |
| 2004/0071576 | A1 * | 4/2004 | Matsumoto | F04C 23/008 418/11 |
| 2017/0138360 | A1 * | 5/2017 | Gao | F04C 18/3562 |

FOREIGN PATENT DOCUMENTS

| | | | |
|---|---|---|---|
| CN | 202659512 | U | 1/2013 |
| EP | 0741245 | A2 | 11/1996 |
| JP | H02294587 | A | 12/1990 |
| JP | H08247065 | A | 9/1996 |
| JP | 2002188574 | A | 7/2002 |
| JP | 2005054742 | A | 3/2005 |
| JP | 4174766 | B2 | 11/2008 |
| JP | 2013221451 | A | 10/2013 |
| KR | 100985672 | B1 | 10/2010 |
| WO | 2009/028261 | A1 | 3/2009 |
| WO | 2012/117599 | A1 | 9/2012 |

OTHER PUBLICATIONS

Japanese Patent Application No. 2015555552, English translation of Notification of Reasons for Refusal dated Aug. 17, 2016, 4 pages.
European Patent Application No. 13881454.6 extended Search and Opinion dated Jun. 16, 2016, 8 pages.
Korean Patent Application No. 2014-7028741 English translation of Notification of Reason for Refusal dated Dec. 15, 2016, 2 pages.
Korean Patent Application No. 2014-7028741 English translation of Notification of Reason for Refusal dated Jun. 29, 2016, 4 pages.
Australian Patent Application No. 2013386506 Patent Examination Report No. 1 dated Aug. 31, 2015, 6 pages.

* cited by examiner

ROTATORY COMPRESSOR AND REFRIGERATING CYCLE DEVICE

CROSS-REFERENCE TO RELATED APPLICATIONS

This application is a U.S. national phase application of International Application No. PCT/CN2013/086363, filed on Oct. 31, 2013, the entire contents of which are incorporated herein by reference.

FIELD

Embodiments of the present disclosure relate to a rotatory compressor and a refrigerating cycle device.

BACKGROUND

Devices including a rotatory compressor are popular worldwide. However, internal pressures in the housings in almost all these rotatory compressors are high. This is a result of advantages such as an energy efficiency and a cost of a high-pressure rotatory compressor, miniaturization, and oil controls. On the other hand, in the point of being environmental friendly to the earth, more attentions are paid to the use of natural refrigerants, such as $CO_2$ and HC refrigerants. In addition, a plan of using HC refrigerants in a rotatory compressor is developing.

However, $CO_2$ has a quite high operation pressure. Therefore, a housing with high internal pressure of a rotatory compressor needs to withstand a pressure of more than 100 MPa and a thickness of a wall of the iron housing needs to be more than 7 mm, which causes significant problems for the production and cost. In addition, since R290 refrigerants of HC series have a strong flammability, the amount of refrigerants sealed in the refrigerating system must be limited. Due to those described above, as to rotatory compressors having a high-pressure housing, it is expected to develop a rotatory compressor which has a thin housing wall, with small amount of sealed refrigerants, and the housing of which being the low-pressure side. Moreover, for a low-pressure rotatory compressor using $CO_2$ (carbonic acid gas) or HC refrigerants (hydrocarbonic acid gas), as the refrigerants has a strong solubility (dissolution) in the lubricating oil, viscosity of the oils may be further significantly reduced.

Reference 1: U.S. Pat. No. 2,988,267 ROTARY COMPRESSOR LUBRICATING ARRANGEMENT (1961).

Reference 2: patent application publication No. JP1998-259787, rotatory sealed compressor and refrigerating device.

SUMMARY

The rotatory compressor according to embodiments of the present disclosure includes a lubricating oil in an interior of a hermetically sealed housing, and an electric motor and a rotatory compressing mechanism disposed in the housing. An internal pressure of the housing is substantially equal to a suction pressure of the compressing mechanism. The compressing mechanism includes: an air cylinder defining a compressing chamber and a sliding vane chamber therein; a piston disposed within the compressing chamber; an eccentric shaft adapted to revolute the piston; a sliding vane disposed in the sliding vane chamber and adapted to reciprocate synchronously with the piston; and a first bearing and a second bearing slidably supporting the eccentric shaft and connected with the sliding vane chamber. A exhaust muffler is within at least one of the first bearing and the second bearing. A refrigerant discharged from the exhaust muffler is adapted to flow through the sliding vane chamber and to be discharged from an exhaust pipe of the compressing mechanism.

With the rotatory compressor according to embodiments of the present disclosure, a sliding surface of the sliding vane may be lubricated efficiently, and all oils in the compressor may be controlled. Therefore, a reliability of the sliding vane may be ensured, and an efficiency decrease of the compressor caused by the lubrication problems may be prevented.

The rotatory compressor according to embodiments of the present disclosure includes a lubricating oil in an interior of a hermetically sealed housing, and an electric motor and a rotatory compressing mechanism disposed in the housing. An internal pressure of the housing is substantially equal to a suction pressure of the compressing mechanism. The compressing mechanism includes: an air cylinder A defining a compressing chamber and a sliding vane chamber therein; an air cylinder B defining a compressing chamber and a sliding vane chamber therein; a partition plate disposed between the air cylinder A and the air cylinder B; pistons disposed within the compressing chambers of the air cylinder A and the air cylinder B respectively; an eccentric shaft adapted to revolute the pistons; sliding vanes disposed in the sliding vane chambers of the air cylinder A and the air cylinder B respectively, and adapted to reciprocate synchronously with the pistons respectively; a first bearing slidably supporting the eccentric shaft and connected with the sliding vane chamber of the air cylinder A, and a first exhaust muffler being within the first bearing; and a second bearing slidably supporting the eccentric shaft and connected with the sliding vane chamber of the air cylinder B, and a second exhaust muffler being within the second bearing. A refrigerant discharged from the first exhaust muffler is adapted to flow through the sliding vane chamber of the air cylinder A and to be discharged from an exhaust pipe of the partition plate, and a refrigerant discharged from the second exhaust muffler is adapted to flow through the sliding vane chamber of the air cylinder B and to be discharged from the exhaust pipe of the partition plate.

With the rotatory compressor according to embodiments of the present disclosure, a sliding surface of the sliding vane may be lubricated efficiently, and all oils in the compressor may be controlled. Therefore, a reliability of the sliding vane may be ensured, and an efficiency decrease of the compressor caused by the lubrication problems may be prevented.

The rotatory compressor according to embodiments of the present disclosure includes a lubricating oil in an interior of a hermetically sealed housing, and an electric motor and a rotatory compressing mechanism disposed in the housing. An internal pressure of the housing is substantially equal to a suction pressure of the compressing mechanism. The compressing mechanism includes: an air cylinder A defining a compressing chamber and a sliding vane chamber therein; an air cylinder B defining a compressing chamber and a sliding vane chamber therein; a partition plate disposed between the air cylinder A and the air cylinder B; pistons disposed within compressing chambers of the air cylinder A and the air cylinder B respectively; an eccentric shaft adapted to revolute the pistons; sliding vanes disposed in the sliding vane chambers of the air cylinder A and the air cylinder B respectively, and adapted to reciprocate synchronously with the pistons respectively; a first bearing slidably supporting the eccentric shaft and connected with the sliding vane chamber of the air cylinder A, and a first exhaust muffler being within the first bearing; and a second bearing slidably supporting the eccentric shaft and connected with the sliding vane chamber of the air cylinder B, and a second exhaust muffler being within the second bearing. A refrigerant discharged from one of the first exhaust muffler and the second exhaust muffler is adapted to flow through the sliding vane chambers of the air cylinder A and the air cylinder B, to combine with a refrigerant discharged from the other one of the first exhaust muffler and the second exhaust muffler, and to be discharged from an exhaust pipe of the compressing mechanism.

With the rotatory compressor according to embodiments of the present disclosure, a sliding surface of the sliding vane may be lubricated efficiently, and all oils in the compressor may be controlled. Therefore, a reliability of the sliding vane may be ensured, and an efficiency decrease of the compressor caused by the lubrication problems may be prevented.

In some embodiments of the present disclosure, the exhaust pipe defines an end extended into the first exhaust muffler.

In some embodiments of the present disclosure, the exhaust pipe defines an end extended into the second exhaust muffler.

The refrigerating cycle device according to embodiments of the present disclosure includes: a rotatory compressor according to embodiments of the present disclosure; an oil separator connected with the exhaust pipe of the rotatory compressor; a condenser connected with the rotatory compressor; an evaporator connected with the rotatory compressor; and an expansion valve connected between the condenser and the evaporator.

In some embodiments of the present disclosure, the oil separator is communicated with an oil injection hole which is open to the compressing chamber in the rotatory compressor, and the oil injection hole is adapted to open and close according to a revolution of the piston disposed within the compressing chamber.

In some embodiments of the present disclosure, the oil separator is communicated with an oil injection hole which is open to the two compressing chambers respectively via the partition plate, and the oil injection hole is adapted to open and close according to revolutions of the pistons disposed in the two compressing chambers respectively.

In some embodiments of the present disclosure, the refrigerant in the rotatory compressor mainly contains a carbonic acid gas or a hydrocarbonic gas, and the lubricating oil in the rotatory compressor mainly contains polyalkylene glycol polymers.

Additional aspects and advantages of embodiments of present disclosure will be given in part in the following descriptions, become apparent in part from the following descriptions, or be learned from the practice of the embodiments of the present disclosure.

BRIEF DESCRIPTION OF THE DRAWINGS

These and other aspects and advantages of embodiments of the present disclosure will become apparent and more readily appreciated from the following descriptions made with reference to the accompanying drawings, in which.

DETAILED DESCRIPTION

Figure 1:
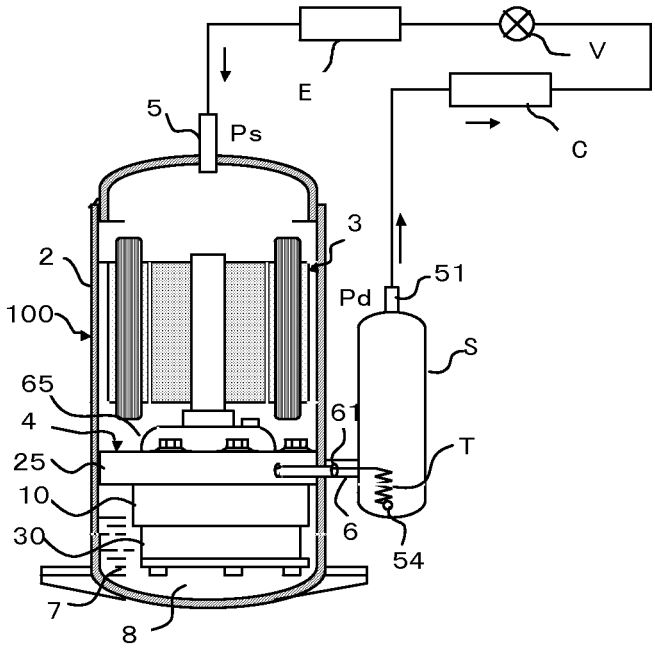
FIG. 1 is a longitudinal cross-sectional view and a refrigerating cycle view related to Embodiment 1 of the present disclosure and representing an interior of a rotatory compressor.

Reference will be made in detail to embodiments of the present disclosure. The embodiments described herein with reference to drawings are explanatory, illustrative, and used to generally understand the present disclosure. The embodiments shall not be construed to limit the present disclosure. The same or similar elements and the elements having same or similar functions are denoted by like reference numerals throughout the descriptions.

In the specification, unless specified or limited otherwise, relative terms such as "central", "longitudinal", "lateral", "above", "below", "front", "rear", "right", "left", "horizontal", "vertical", "top", "bottom", "inner", "outer" should be construed to refer to the orientation as then described or as shown in the drawings. These terms are merely for convenience and concision of description and do not alone indicate or imply that the device or element referred to must have a particular orientation. Thus, it cannot be understood to limit the present disclosure. In addition, terms such as "first" and "second" are used herein for purposes of description and are not intended to indicate or imply relative importance or significance or impliedly indicate quantity of the technical feature referred to. Thus, the feature defined with "first" and "second" may comprise one or more this feature. In the description of the present disclosure, "a plurality of" means two or more than two this features, unless specified otherwise.

In the present invention, unless specified or limited otherwise, the terms "mounted," "connected," "coupled," "fixed" and the like are used broadly, and may be, for example, fixed connections, detachable connections, or integral connections; may also be mechanical or electrical connections; may also be direct connections or indirect connections via intervening structures; may also be inner communications of two elements, which can be understood by those skilled in the art according to specific situations.

A rotatory compressor according to embodiments of the present disclosure will be described below with reference to FIGS. 1-8.

In a rotatory compressor in which a housing being a high-pressure side, due to a pressure difference between the housing (high-pressure side) and the compressor (low-pressure side), oils with an amount being about 5% to 7% of the refrigerating cycle are supplied to the compressor via a sliding gap between the sliding parts. In addition, a mixture of discharged oils and the refrigerants is separated in the housing, and an amount of oil supplied to a refrigerating system may be reduced to be smaller than 1%.

On the other hand, in a rotatory compressor having a low back pressure housing, since an internal pressure in the housing is low pressure, and with the influence of a pressure difference, oils cannot be supplied into the compressor. With a relative small pressure drop generated by a pressure drop of an air suction hole of the air cylinder, oils stored in the housing are supplied into the compressor. An oil supplying amount of this compressor is substantially the same as that of a high-pressure rotatory compressor. However, in order to prevent a degradation of performances of the refrigeration cycle, the amount of oils supplied to the refrigerating cycle must be smaller than 1%. Therefore, oils may be recovered by an oil separator with high separating efficiency, and the recovered oils may be fed back to the compressor and an interior of the housing.

In a condition the oils are recovered to the compressor, the recovered oils may be utilized again. Oils having an amount same as those of oils cannot by separated by the oil separator, i.e. with an amount equal to the amount of oils supplied (generally being smaller than 1% of the amount of the refrigerating cycle), may be supplied to the compressor. As to recovering the oils into the interior of the housing of the compressor, recovering the oils into the housing of the compressor is easy. However, the oils cannot be utilized again in the compressor, thus causing the amount of oils that supplied to the compressor to increase. In addition, due to an expansion loss of the refrigerants contained in oils recovered into the housing, a volume efficiency of the compressor may be reduced.

Therefore, using the method of recovering oils into the compressor is advantageous. Even using this method, however, in a low-pressure rotatory compressor, since a sliding vane chamber receiving a back of the sliding vane is in a high-pressure sealed chamber, a sliding gap between the sliding vanes may not be sufficiently lubricated, thus generating a wear. In order to implement a low-pressure rotatory compressor, an oil control in the interior of the compressor is of the most significant importance.

According to embodiments of the present disclosure, lubricating methods for the sliding vane have been researched, and a recycle of oils is further applied. Specifically speaking, about 5% mixed oil-containing refrigerants discharged into an exhaust muffler of the second bearing 30 (B) flow from a gas passage (B) 33 through a sliding vane chamber 12, and flow through an exhaust pipe 6 connected with a first bearing flange 25*a* to an oil separator S. During the refrigerant mixtures flowing through the sliding vane chamber 12 (high-pressure side), since oils are supplied into a sliding vane gap of the sliding vane 20 due to a pressure difference in the compressor 13 (low pressure-high pressure), the sliding vane 20 is lubricated. Oils 7 contained in the oil separator S may be supplied into an oil injection hole 62 (which is open to the compressor 13) so as to lubricate a sliding vane 24 and a front end of the sliding vane 20.

With the rotatory compressor according to embodiments of the present disclosure, a sliding surface of the sliding vane may be lubricated efficiently, and all oils in the compressor may be controlled. Therefore, a reliability of the sliding vane may be ensured, and an efficiency decrease of the compressor caused by the lubrication problems may be prevented.

Embodiment 1

A rotatory compressor 100 and a refrigeration cycle according to Embodiment 1 of the present disclosure are shown in FIG. 1. The rotatory compressor 100 includes a compressing mechanism 4 mounted in an interior of an enclosed housing 2 and an electric motor 3 arranged at a top of the enclosed housing 2. The compressing mechanism 4 includes an air cylinder 10, a first bearing 25 and a second bearing 30 fixed in the interior of the housing 2, and these parts are assembled via screws. An exhaust pipe 6 and an oil injection pipe 61 connected with a periphery of the first bearing 25 are connected with an oil separator S. In order to adjust an oil supplying amount to the compressing chamber, a capillary pipe T is mounted between the oil injection pipe 61 and the oil separator S. In addition, an air suction pipe 5 is disposed at the top of the housing 2, and oils 7 are sealed in an oil pool 8. In addition, the air suction pipe 5 may also be arranged between a motor 3 and the compressing mechanism 4.

After a low-pressure refrigerant flowing from the air suction pipe 5 into the housing 2 has cooled the motor 3, it is sucked into the air cylinder 10 via the interior of the air suction lid 65. A high-pressure refrigerant compressed in the air cylinder 10 is discharged from the exhaust pipe 6 into the oil separator S via the interior of the compressing mechanism 4 in a manner described in detail in the following. Oils contained in the discharged high-pressure refrigerant are separated in the oils separator S. The separated oils are stored in the bottom of the oil separator S, and the refrigerant whose oils have been separated is discharged from an exhaust pipe 51 of the separator to a condenser C.

In the condenser C, the cooled high-pressure refrigerant flows from an expansion valve V to an evaporator E and becomes a low-pressure refrigerant, which is sucked into the housing 2 starting from the air suction pipe 5. Therefore, a refrigerant cycling system of the refrigerant cycle is obtained. Moreover, oils separated in the oils separator S return from the oil injection pipe 61 to a compressing chamber 13 defined in the air cylinder 10 in a manner described in the following. The symbol Ps in FIG. 1 is a pressure of the low-pressure refrigerant, and the symbol Pd represents a pressure of the high-pressure refrigerant.

Figure 2:
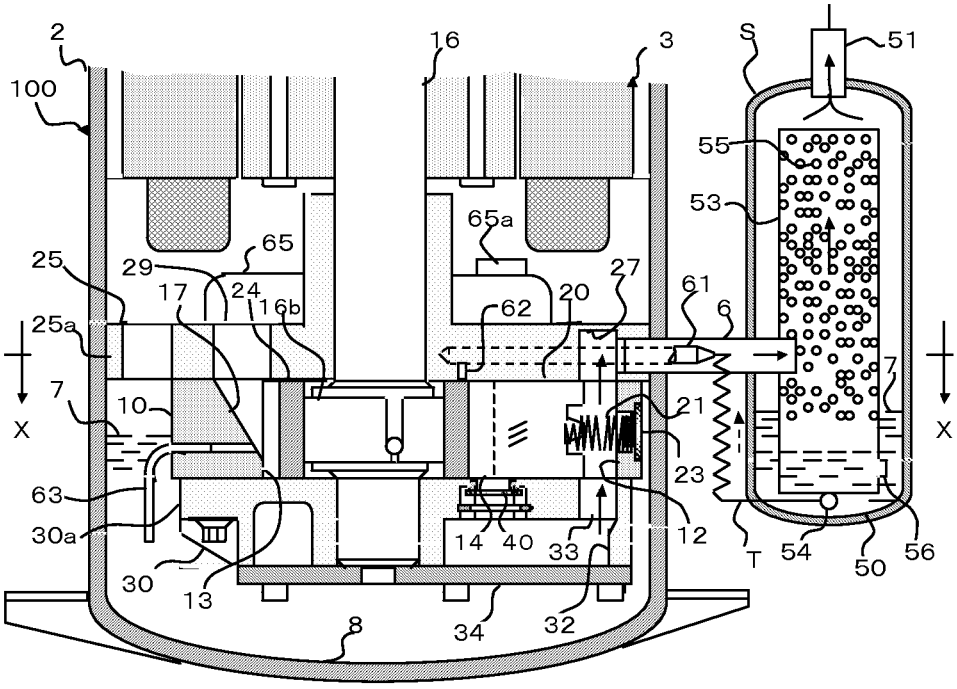
FIG. 2 is a longitudinal cross-sectional view related to Embodiment 1 and representing a detailed construction of a compressing mechanism.

FIG. 2 represents a detailed cross-sectional diagram of the compressing mechanism. A cylindrical compressing chamber 13 is disposed in the middle of the air cylinder 10, which is sealed by a first bearing flange 25*a* and a second bearing flange 30*a*. An eccentric shaft 16 is slidably supported by the first bearing 25 and the second bearing 30. A piston 24 arranged in the compressing chamber 13 is revoluted by the eccentric shaft 16 and the eccentric shaft part 16*b*. The sliding vane 20 performs a reciprocating motion together with the revolution of the piston 24, and the sliding vane 20 slides in a sliding vane groove 15 (shown in FIG. 3) in the air cylinder 10.

The sliding vane chamber 12 connected with the first bearing flange 25*a* and the second bearing flange 30*a* respectively and located at the back of the sliding vane 20 receives the sliding vane 20 which is adapted to reciprocate. In addition, the sliding vane chamber 12 is also a chamber in which a sliding vane spring 21 fixed at the back of the sliding vane 20 may be retractable. The sliding vane 20 performs a reciprocating motion together with the piston via a pressure difference between the back side and the front end of the sliding vane 20, and therefore the sliding vane chamber 12 generally is the high-pressure side. The sliding vane chamber 12 communicated with the exhaust muffler (B) is generally a high-pressure chamber. The processing hole for receiving the sliding vane spring 21 is sealed by a sliding plate 23.

The lower surface of the second bearing 30 is sealed by a flat plate (B), therefore an exhaust muffler (B)32 is formed in the second bearing 30. The exhaust muffler (B)32 includes an exhaust hole 14 which is open to the compressing chamber 13. An exhaust valve 40 having a circular plate shape is used to open or close the exhaust hole 14. The exhaust valve of a rotatory compressor is generally a tongue-shape valve. In Embodiment 1, an efficient circular valve is applied in order to reduce an internal volume of the exhaust muffler (B)32.

As a feature of Embodiment 1, the gas passage (B)33 of the second bearing flange 30*a* is open to an open end of the sliding vane chamber 12, and the gas passage (A)27 of the first bearing flange 25*a* is open to the open end of the sliding vane chamber 12. Moreover, the gas passage (A)27 is connected with the exhaust pipe 6. A separating cylinder 53 formed in the front end side of the exhaust pipe 6 that is connected with an interior of the oil separator S is open to the interior thereof.

A suction lid 65 made by stamping is fixed on the top of the first bearing flange 25*a*. The first bearing flange 25*a* has a first bearing suction hole 29, and is connected to an air cylinder suction hole 17 in the air cylinder 10. Therefore, the low-pressure refrigerant from the housing 2 flows from the cover plate hole 65*a* into the suction lid 65, and is sucked into the compressing chamber 13 in a sequence from the first bearing suction hole 29 to the air cylinder suction hole 13*a*.

The low-pressure refrigerant sucked into the compression chamber 13 is compressed into a high-pressure refrigerant, is discharged from the exhaust hole 14 to the exhaust muffler (B)32, flows from the gas passage (B)33 and through the sliding vane chamber 12, and then discharged from the exhaust pipe 6 to the separating cylinder 53 of the oil separator S. Herein, an oil supplying pipe 63 which is open to the air cylinder suction hole 13*a* sucks the oil 7 in the oil pool 8 due to a pressure difference generated in the air cylinder suction hole 13*a*, and a small amount of oil 7 may be supplied into the compression chamber 13.

The oils supplied from the compressing chamber 13 may be used to lubricate upper and lower plane sliding surfaces of the piston 24 and a sliding surface of a front end of the sliding vane, and may be used to prevent an air leakage from a sliding gap and an outer periphery of the piston due to a pressure difference. If oils are only supplied to the compressing chamber, however, it is impossible to lubricate the sliding surface of the sliding vane hided in the sliding vane groove 15.

Subsequently, in order to lubricate the piston and the front end of the sliding vane 20 in the compressing chamber 13 and to compress the refrigerant efficiently, a required oil supplying amount (G) may be 5% of an amount (Q) of refrigerants cycling in the refrigerant cycle system (G/Q=0.05). In addition, a reason that the required oil supplying amount (G) of the compressing chamber 13 being 5% of the refrigerant amount (Q) may be obtained by increasing G gradually and making the refrigerating capability COP of the compressor be the maximum test data with a G ranging from 5% to 7% in a performance test of the compressor.

The high-pressure refrigerant compressed in the compressing chamber 13 is an oil-refrigerant mixture (referred to as a refrigerant mixture) of the refrigerant and 5% oil mist, discharged from the exhaust hole 14 through the exhaust muffler (B)32, and from the gas passage (B)33 through the sliding vane chamber 12, and then from the exhaust pipe 6 connected with the gas passage (A)27 to the separator cylinder 53, and further flows into the separator housing 50 via a plurality of slots 55 in the separating cylinder 53. Then, oils separated by the slots 55 fall into the separator housing 50 to be stored. In addition, oils separated in the separator cylinder 53 fall into the separating cylinder 53, and flow through a bottom hole 56, and then combine with the oils 7 in the separator housing 50.

During the flowing process of the refrigerant mixture, since there is a pressure difference between the sliding vane chamber 12 at the high-pressure side and the compressing chamber 13 (low pressure-high pressure), a part of refrigerant mixture starting from the sliding vane chamber 12 may enter into a sliding gap formed between the sliding vane 20 and the sliding vane groove 15. The refrigerant mixture entered into the sliding gap lubricates the sliding vane surfaces of the sliding vane 20 formed by four planes, and prevents a refrigerant leakage from the gap into the compressing chamber 13. Therefore, not only a wear generated due to a violent sliding of the sliding vane 20, and also a reduction of a volume efficiency of the compressor caused by a high-pressure refrigerant leakage may be prevented. In addition, a fact that oils which finishes lubrication of the sliding vane 12 flow to the compressing chamber 13 is finished.

Therefore, it is concluded that, an amount (g) (even in a case the amount is relatively more) of oils flowing from the sliding vane chamber 12 into the compressing chamber 13 via the sliding gap is substantially about 1% of the amount (Q) of cycling refrigerant. If the amount (g) of oil is 1%, the amount G-g of oils flowing from the exhaust pipe 6 to the oils separator S is 4%. Moreover, if an oil separating efficiency of the oil separator S is 5%, the amount of oils supplied from an exhaust pipe 51 of the separator to the refrigerant cycle is 1%, and the amount of oils remained in the separator housing 50 is 3%.

As described above, the method of the present embodiment includes return the oils remained in the separator housing 50 into the compressing chamber 13. FIG. 2 is an X-X cross-sectional diagram of FIG. 3, with an oil injection pipe 61 connected with the first bearing flange 25*a*, the oil 7 from the separator housing 50 returns to the compressing chamber 13 from the oil injection hole 62 which is open to the compressing chamber 13.

As to the oil injection hole 62, since a rotation angle of the piston which is opened or closed through a plane sliding surface of the revolution piston 24 is preset, the high-pressure refrigerant may not flow reversely from the compressing chamber 13 to the oil injection pipe 61. In addition, in the present design, the high-pressure oil may not be leaked into the low-pressure side of the compressing chamber 13. Therefore, 3% oils may be returned to the compressing chamber 13 from the separator housing 50. In addition, in the references 1 and 2, the oil injection hole is opened due to the rotation angle of the piston, and the method and effect of injecting oils in the compressing chamber is described in detail.

If 3% oils are recovered from the oil separator S to the compressing chamber 13 via the oil injection pipe 61, the amount (g) of oils flowing from the sliding vane chamber 12 to the compressing chamber 13 is 1%. If the amount of oils supplied starting from the oils supplying pipe 63 is 1%, the oil supplying amount in the compressing chamber 13 is 5%, which may ensure a required oil supplying amount (G). In other words, total oils in the compressor may be controlled. In addition, the amount of required oils from the oil supplying pipe 63 is generally equal to the amount of oils supplied to the refrigerating cycle (OCR).

Herein, a capillary T is provided to adequately recover oils remained in the separator housing 50 into the compressing chamber 13. In other words, if a resistance of the capillary T is too great, the amount of oils injected into the compression chamber may be reduced, and oils stored in the separator housing 50 may increase, and therefore oils supplied to the refrigerating cycle may increase. On the contrary, if the resistance of the capillary T is too small, there may be no oil remained in the separator housing 50, and the high-pressure refrigerant may be injected into the compressing chamber 13, and therefore the volume efficiency of the compressor may be reduced.

Figure 3:
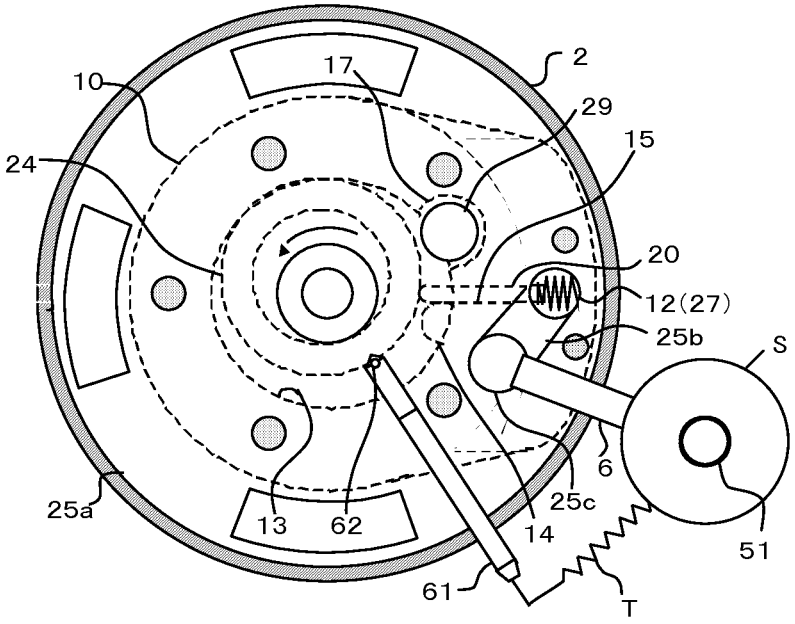
FIG. 3 is a plane cross-sectional view related to Embodiment 1 and representing a construction of a compressing mechanism.

In addition, as shown in FIG. 3, at the first bearing flange 25*a*, in a condition that it is difficult to assemble the exhaust pipe 6 on the top of the sliding vane chamber 12, if an exhaust groove 25*c* and a loop 25*b* communicated with the gas passage (A)27 disposed at an upper part of the sliding vane chamber 12 are provided on the first bearing flange 25*a*, it may be easy to assemble the exhaust pipe 6. In addition, a distance between the exhaust pipe 6 and the oil injection pipe 61 may be reduced, and therefore the arrangement of the oil separator may be easy.

As described above, in Embodiment 1, the refrigerant mixture containing 5% oils is used to lubricate the compressing chamber 13, and the refrigerant mixture is guided into the sliding vane chamber 12, and therefore the problem to lubricate the sliding surface of the sliding vane 20 is solved. In addition, with the oil injection pipe 61, the oil 7 recovered by the oil separator S may automatically return to the compressing chamber 13, and thereby an oil cycling system of the compressor is established.

Embodiment 2

Figure 4:
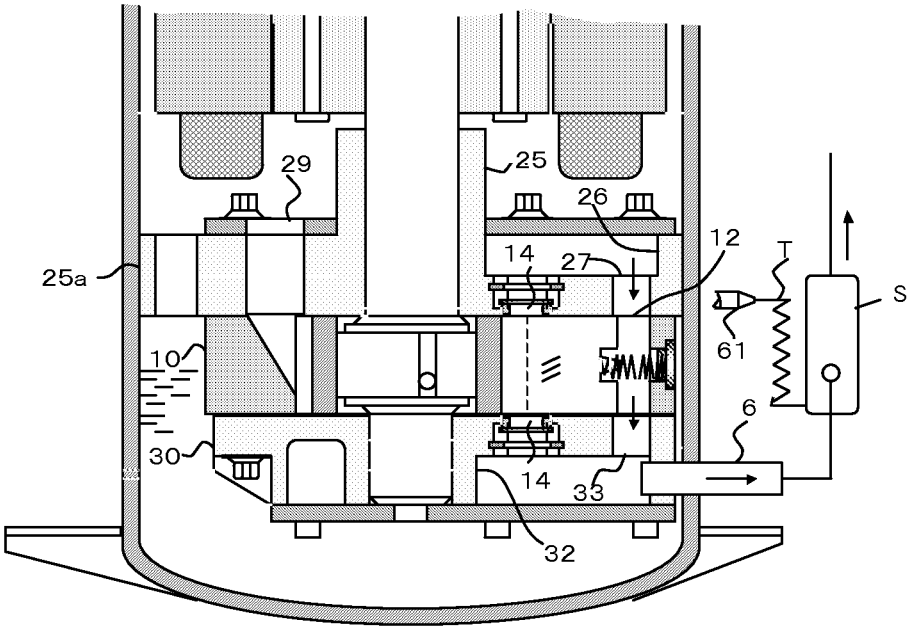
FIG. 4 is a longitudinal cross-sectional view related to Embodiment 2 of the present disclosure and representing a detailed construction of a compressing mechanism.
Figure 5:
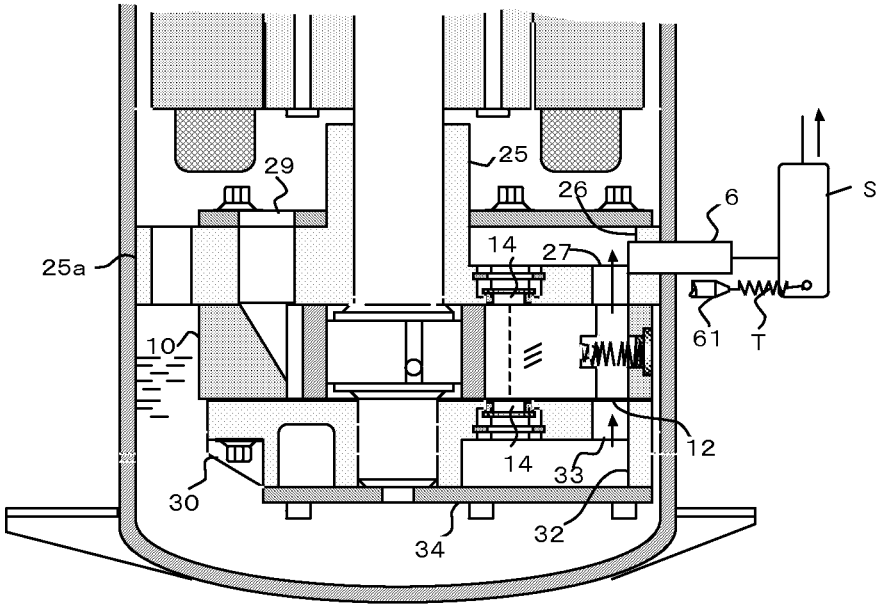
FIG. 5 is a longitudinal cross-sectional view related to Embodiment 2 and representing a detailed construction of a compressing mechanism.

In a design of Embodiment 4, exhaust mufflers are provided at the second bearing side 30 and the first bearing side 25 based on the design of Embodiment 2. In addition to the exhaust muffler (B)32 of the second bearing 30, the first bearing 25 also needs the exhaust muffler (A)26. The exhaust pipe 6 is arranged at one side of the exhaust muffler. In FIG. 4, the exhaust pipe 6 is arranged in the exhaust muffler (B)32. In FIG. 5, the exhaust pipe 6 is arranged in the exhaust muffler (B)26.

In the first bearing 25, the refrigerant mixture discharged from the exhaust hole 14 which is open to the compressing chamber 13 into the exhaust muffler (B)26 via the sliding vane chamber 12 and the high-pressure refrigerant of the exhaust muffler (B)32 are combined and flow from the exhaust pipe 6 to the oil separator S. Subsequently, the separated oil and refrigerant is discharged into the refrigerating cycle with a path the same as that of Embodiment 1. In addition, the oils separated by the oil separator S return from the oil injection pipe 61 to the compressing chamber 13. Moreover, although a flowing direction of the refrigerant in the sliding vane chamber 12 is opposite, the same effects may be obtained in both Embodiment 5 and Embodiment 4.

Embodiment 3

Figure 6:
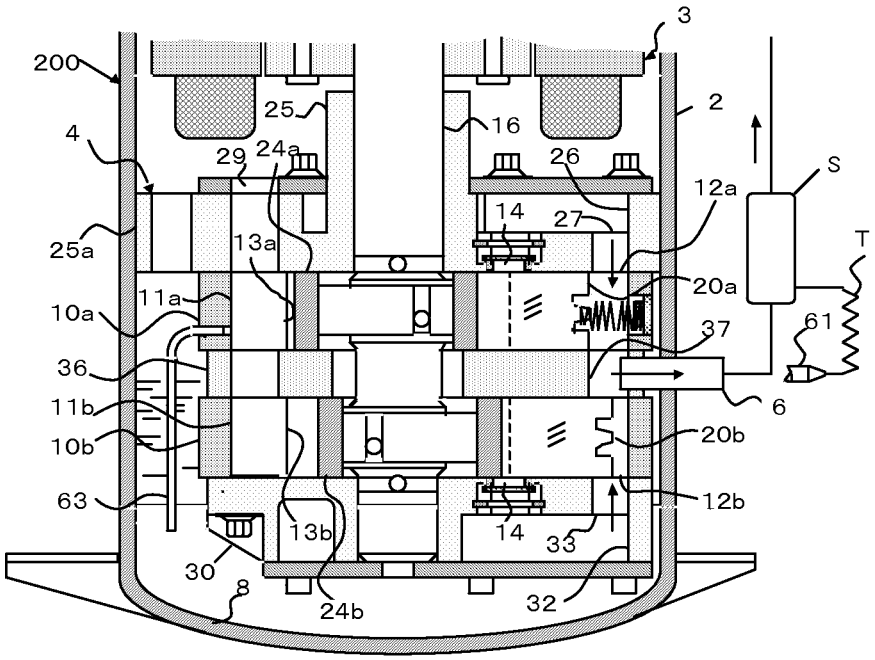
FIG. 6 is a longitudinal cross-sectional view related to Embodiment 3 of the present disclosure and representing a detailed construction of a compressing mechanism.

Embodiment 3 shown in FIG. 6 represents a method for lubricating the sliding vane of Embodiment 1, and the oil control method may be used in a low-pressure rotatory compressor having two air cylinders.

A compressing mechanism 4 of the rotatory compressor 200 having two air cylinders includes an air cylinder (A)10*a* having a compressing chamber 13*a*, an air cylinder (B)10*b* having a compressing chamber 13*b*, a partition plate 36 disposed between the air cylinder (A)10*a* and the air cylinder (B)10*b*, a piston 24*a* and a sliding vane 20*a* in the air cylinder (A)10*a*, a piston 24*b* and a sliding vane 20*b* in the air cylinder (B)10*b*, an eccentric shaft 16 adapted to revolute the two pistons, and a first bearing 25 and a second bearing 30 adapted to slidably support the eccentric shaft 16 and connect with the two air cylinders respectively.

The first bearing 25 includes an exhaust hole 14 which is open to the compressing chamber 13*a*, and the second bearing 30 includes an exhaust hole 14 which is open to the compressing chamber 13*b*. The first bearing 25 includes an exhaust muffler (A)26, and the second bearing 30 includes an exhaust muffler (B)32, i.e. the exhaust muffler (A)26 is an exhaust muffler of the first bearing, and the exhaust muffler (B)32 is an exhaust muffler of the second bearing. In addition, a cylinder suction hole (A)11*a* is connected with an oil supplying pipe 63. Moreover, as recorded in the reference 2, the sliding vane 20*b* has no sliding vane spring.

The low-pressure refrigerant flowing through the first bearing suction hole 29 flows from the cylinder suction hole (A)11*a* through the compressing chamber 13*a*, and flows from the cylinder suction hole (B)11*b* to the compressing chamber 13*b* via the partition plate 36. The refrigerant mixtures separated in the compressing chambers respectively and containing oils are discharged into the exhaust muffler (A)26 and the exhaust muffler (B)32. The refrigerant mixture of the exhaust muffler (A)26 flows into the sliding vane chamber (A)12*a* via a gas passage (A)27, and the refrigerant mixture of the exhaust muffler (B)32 flows into the sliding vane chamber (B)12*b* via a gas passage (A)33. Theses refrigerant mixtures are combined in the exhaust pipe 6 in the gas hole 37 of the partition plate 37 and discharged into the oil separator S.

Since the refrigerant mixtures flow through the sliding vane chamber (A)12*a* and the sliding vane chamber (B)12*b* respectively, the sliding vane 20*a* the sliding vane 20*b* may be lubricated as described in Embodiment 1. In addition, as a refrigerant passage the two sliding vane chambers each with a large passage area may significantly reduce an exhaust resistance. Further, by arranging the partition plate 36 in the exhaust pipe 6, a length of the exhaust passage may be reduced, and the exhaust resistance may be further reduced. With these effects, a compression loss of the compressor is reduced, and the efficiency of the compressor may be improved.

Figure 7:
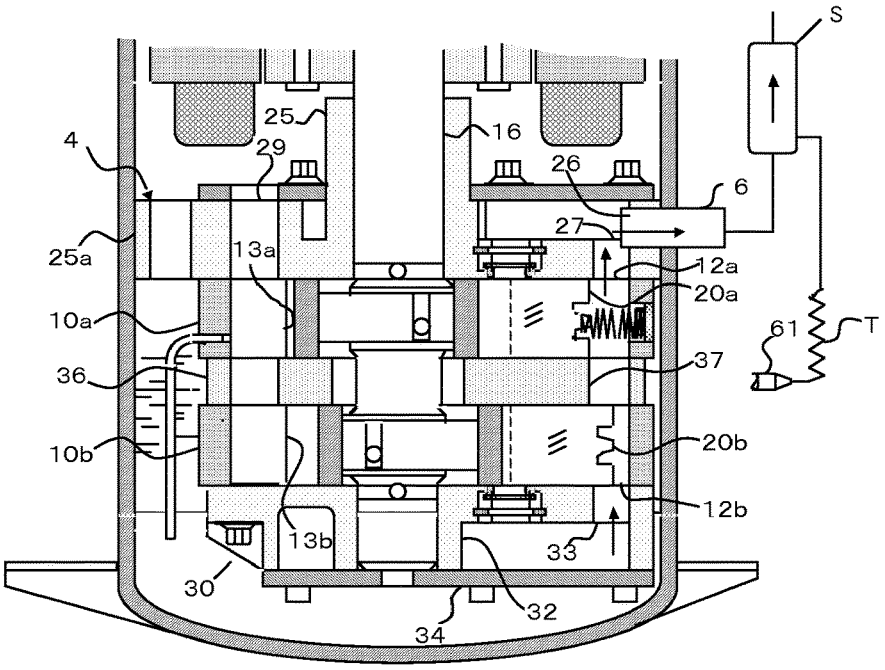
FIG. 7 is a longitudinal cross-sectional view related to Embodiment 3 and representing a detailed construction of a compressing mechanism.

The technique of FIG. 7 is an alternative technique of FIG. 6, in which the exhaust pipe 6 is arranged in the exhaust muffler (A)26. The refrigerant mixture of exhaust muffler (B)32 flows from the gas passage (B)33, and flows in a sequence of the sliding vane 20*b* and the sliding vane 20*a*, and then combine with the refrigerant mixture of exhaust muffler (A)26. The combined refrigerant mixtures are discharged from the exhaust pipe 6 into the oil separator S. The alternative technique is the same as the design in FIG. 6, oils may be supplied to the sliding vane 20*a* and the sliding vane 20*b*, and the sliding vane 20*a* and the sliding vane 20*b* may be lubricated. In addition, in FIG. 7, the exhaust pipe 6 may also be arranged in the exhaust muffler (B)32.

In a low-pressure rotatory compressor having two air cylinders, both the compressing chamber 13*a* and the compressing chamber 13*b* need to be supplied with oils. Therefore, in comparison with the design of Embodiment 1, the amount of oils supplied to the compressing chamber may be increased. Although a total discharging amount of the two air cylinders is the same with the discharging amount of one air cylinder, a total sliding area of the sliding parts in the compressor having two air cylinders may be greater than 1.5 times of that in the compressor having one air cylinder.

For example, if a required oil supplying amount (G) of the compressing chamber of a compressor having one air cylinder is 5%, a required oil supplying amount (G) of the two compressing chambers of a compressor having two air cylinders is increased to 8% to 10%. Moreover, oils separated in the oil separator are required to be returned uniformly into the compressing chamber 13*a* and the compressing chamber 13*b*. In such as background, as to a low-pressure rotatory compressor having two air cylinders, the method for supplying oils to the compressing chamber needs to use a method with relatively smaller errors.

Figure 8:
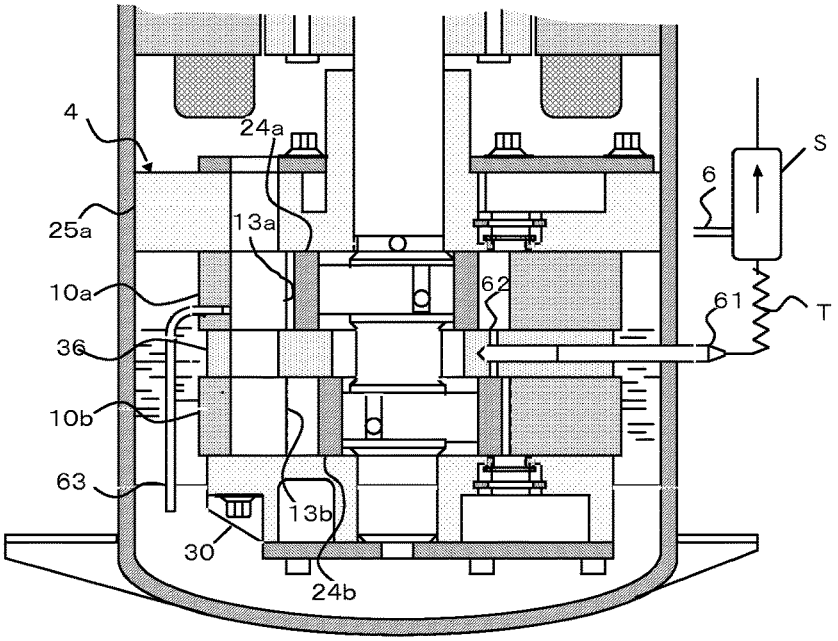
FIG. 8 is a longitudinal cross-sectional view related to Embodiment 3 and representing a detailed construction of a compressing mechanism.

As a solution to the above problems, FIG. 8 shows a method for supplying oils from the oil separator S to the compressing chamber 13*a* and the compressing chamber 13*b*. An oil injection 62 formed in a front end of the oil injection pipe 61 connected with the partition plate 36 and communicated with the compressing chamber 13*a* and the compressing chamber 13*b* respectively may be opened and closed according to the pistons 24 in the compressing chambers as described in Embodiment 1, and required amount of oils may be precisely supplied into the compressing chambers. In other words, the two oil injection holes 62 are communicated to form one through hole, and therefore positions and diameters of these openings may have no errors. In addition, there is one loop including the oil injection pipe 61 and the capillary, which is featured by a fact that, the amounts of oils supplied into two compressing chambers may not be different.

In addition, if the required oil supplying amount (G) of the compressing chamber is 4% and the amount (g) of oils supplied from each sliding vane chamber into each the compressing chamber via the sliding gap is 0.5% respectively, an total amount of oils discharged from the exhaust pipe 6 to the oil separator S may be 7% (2 G-2 g). Moreover, if the amount of oils discharged from the oil separator S to the refrigerating cycle is 1%, a required oil supplying amount of oils supplied from the oil supplying pipe 63 may be 1%. Therefore, the design of Embodiment 3 may also be applied in a low-pressure rotatory compressor having two air cylinders.

The technique disclosed in the present invention may be used in a rotatory compressor having one air cylinder and a housing being the low pressure side, a rotatory compressor having two air cylinders, and an oscillation-type rotatory compressor. In devices using $CO_2$ and HC refrigerants etc, such as an air conditioner, a refrigerating device, a water heater, etc., the low-pressure rotatory compressor with higher operation efficiency and reliability according to embodiments of the present disclosure may be applied flexibly. In addition, with an assistance of current mass-produced apparatus, the manufacturability is better.

Reference throughout this specification to "an embodiment," "some embodiments," "one embodiment", "another example," "an example," "a specific example," or "some examples," means that a particular feature, structure, material, or characteristic described in connection with the embodiment or example is included in at least one embodiment or example of the present disclosure. Thus, the appearances of the phrases such as "in some embodiments," "in one embodiment", "in an embodiment", "in another example," "in an example," "in a specific example," or "in some examples," in various places throughout this specification are not necessarily referring to the same embodiment or example of the present disclosure. Furthermore, the particular features, structures, materials, or characteristics may be combined in any suitable manner in one or more embodiments or examples.

Although explanatory embodiments have been shown and described, it would be appreciated by those skilled in the art that the above embodiments cannot be construed to limit the present disclosure, and changes, alternatives, and modifications can be made in the embodiments without departing from spirit, principles and scope of the present disclosure.

What is claimed is:

1. A rotatory compressor comprising a lubricating oil in an interior of a hermetically sealed housing, and an electric motor and a rotatory compressing mechanism disposed in the housing, wherein an internal pressure of the housing is substantially equal to a suction pressure of the rotary compressing mechanism, and the rotary compressing mechanism comprises:

an air cylinder defining a compressing chamber and a sliding vane chamber therein;

a piston disposed within the compressing chamber;

an eccentric shaft adapted to revolute the piston;

a sliding vane disposed in the sliding vane chamber and adapted to reciprocate synchronously with the piston; and a first bearing and a second bearing slidably supporting the eccentric shaft and connected with the sliding vane chamber, wherein an exhaust muffler is within one of the first bearing and the second bearing, an exhaust pipe is connected with the other one of the first bearing and the second bearing, the exhaust muffler is communicated with the sliding vane chamber, the exhaust pipe is communicated with the sliding vane chamber, and the compressing chamber is capable of being communicated with the exhaust muffler, such that a refrigerant entering the exhaust muffler from the compressing chamber is discharged through the sliding vane chamber and the exhaust pipe.

2. A rotatory compressor according to claim 1, wherein the rotary compressing mechanism further comprises:

the air cylinder is an air cylinder A defining the compressing chamber being a first compression chamber and the sliding vane chamber being a first sliding vane chamber therein;

an air cylinder B defining a second compressing chamber and a second sliding vane chamber therein;

a partition plate disposed between the air cylinder A and the air cylinder B;

pistons disposed within the first and second compressing chambers of the air cylinder A and the air cylinder B respectively;

an eccentric shaft adapted to revolute the pistons;

sliding vanes disposed in the first and second sliding vane chambers of the air cylinder A and the air cylinder B respectively, and adapted to reciprocate synchronously with the pistons respectively;

a first bearing slidably supporting the eccentric shaft and connected with the first sliding vane chamber of the air cylinder A, and the exhaust muffler is a first exhaust muffler being within the first bearing; and a second bearing slidably supporting the eccentric shaft and connected with the second sliding vane chamber of the air cylinder B, and a second exhaust muffler being within the second bearing, wherein a refrigerant discharged from one of the first exhaust muffler and the second exhaust muffler is adapted to flow through the sliding vane chambers of the air cylinder A and the air cylinder B, to combine with a refrigerant discharged from the other one of the first exhaust muffler and the second exhaust muffler, and to be discharged from an exhaust pipe connected with the other one of the first exhaust muffler and second exhaust muffler.

3. The rotatory compressor according to claim 2, wherein the exhaust pipe defines an end extended into the first exhaust muffler.

4. The rotatory compressor according to claim 2, wherein the exhaust pipe defines an end extended into the second exhaust muffler.

5. The rotatory compressor according to claim 1, wherein the exhaust muffler is formed in the second bearing, a first bearing flange of the first bearing defines a gas passage A therein, a second bearing flange of the second bearing defines a gas passage B therein, the gas passage A is open to an open end of the sliding vane chamber, the gas passage B is open to the open end of the sliding vane chamber, the gas passage A is connected with the exhaust pipe, and the gas passage B is communicated with the exhaust muffler.

6. A rotatory compressor comprising a lubricating oil in an interior of a hermetically sealed housing, and an electric motor and a rotatory compressing mechanism disposed in the housing, wherein an internal pressure of the housing is substantially equal to a suction pressure of the compressing mechanism, and the rotary compressing mechanism comprises:

an air cylinder A defining a first compressing chamber and a first sliding vane chamber therein;

an air cylinder B defining a second compressing chamber and a second sliding vane chamber therein;

a partition plate disposed between the air cylinder A and the air cylinder B;

pistons disposed within the first and second compressing chambers of the air cylinder A and the air cylinder B respectively;

an eccentric shaft adapted to revolute the pistons;

sliding vanes disposed in the first and second sliding vane chambers of the air cylinder A and the air cylinder B respectively, and adapted to reciprocate synchronously with the pistons respectively;

a first bearing slidably supporting the eccentric shaft and connected with the first sliding vane chamber of the air cylinder A, and a first exhaust muffler being within the first bearing; and a second bearing slidably supporting the eccentric shaft and connected with the second sliding vane chamber of the air cylinder B, and a second exhaust muffler being within the second bearing, wherein a refrigerant discharged from the first exhaust muffler is adapted to flow through the first sliding vane chamber of the air cylinder A and to be discharged from an exhaust pipe connected to the partition plate, and wherein a refrigerant discharged from the second exhaust muffler is adapted to flow through the second sliding vane chamber of the air cylinder B and to be discharged from the exhaust pipe connected to the partition plate.

7. The rotary compressor according to claim 6, wherein an oil separator is communicated with an oil injection hole which is open to the first and second compressing chambers in the rotatory compressor via the partition plate, and the oil injection hole is adapted to open and close according to revolutions of the pistons disposed in the first and second compressing chambers respectively.

8. A refrigerating cycle device comprising:

a rotatory compressor comprising a lubricating oil in an interior of a hermetically sealed housing, and an electric motor and a rotatory compressing mechanism disposed in the housing, wherein an internal pressure of the housing is substantially equal to a suction pressure of the rotary compressing mechanism, and the rotary compressing mechanism comprises:

an air cylinder defining a compressing chamber and a sliding vane chamber therein, a piston disposed within the compressing chamber, an eccentric shaft adapted to revolute the piston, a sliding vane disposed in the sliding vane chamber and adapted to reciprocate synchronously with the piston, and a first bearing and a second bearing slidably supporting the eccentric shaft and connected with the sliding vane chamber, wherein an exhaust muffler is within one of the first bearing and the second bearing, an exhaust pipe is connected with the other one of the first bearing and the second bearing, the exhaust muffler is communicated with the sliding vane chamber, the exhaust pipe is communicated with the sliding vane chamber, and the compressing chamber is capable of being communicated with the exhaust muffler, such that a refrigerant entering the exhaust muffler from the compressing chamber is discharged through the sliding vane chamber and the exhaust pipe;

an oil separator connected with the exhaust pipe of the rotatory compressor;

a condenser connected with the rotatory compressor;

an evaporator connected with the rotatory compressor; and an expansion valve connected between the condenser and the evaporator.

9. The refrigerating cycle device according to claim 8, wherein the oil separator is communicated with an oil injection hole which is open to the compressing chamber in the rotatory compressor, and the oil injection hole is adapted to open and close according to a revolution of the piston disposed within the compressing chamber.

10. The refrigerating cycle device according to claim 8, wherein the refrigerant in the rotatory compressor mainly comprises a carbonic acid gas or a hydrocarbonic gas, and the lubricating oil in the rotatory compressor mainly comprises polyalkylene glycol polymers.

11. The refrigerating cycle device according to claim 8, wherein the exhaust muffler is formed in the second bearing, a first bearing flange of the first bearing defines a gas passage A therein, a second bearing flange of the second bearing defines a gas passage B therein, the gas passage A is open to an open end of the sliding vane chamber, the gas passage B is open to the open end of the sliding vane chamber, the gas passage A is connected with the exhaust pipe, and the gas passage B is communicated with the exhaust muffler.

* * * * *